US005138933A

United States Patent [19]

Weitzel et al.

[11] Patent Number: 5,138,933

[45] Date of Patent: Aug. 18, 1992

[54] ACTIVATOR DEVICE FOR MOVABLE COMPONENTS

[75] Inventors: Paul S. Weitzel, Canal Fulton, Ohio; Bernard M. McCoy, Lumberton, Tex.

[73] Assignee: The Babcock & Wilcox Company, New Orleans, La.

[21] Appl. No.: 451,910

[22] Filed: Dec. 18, 1989

[51] Int. Cl.[5] ..... F15B 11/08

[52] U.S. Cl. ..... 91/462; 91/1; 91/454; 60/413; 60/415; 92/5.00 R

[58] Field of Search ..... 60/413, 415; 91/29, 91/32, 454, 462, 1; 251/62; 92/5 R

[56] References Cited

U.S. PATENT DOCUMENTS

| | | | |
|---|---|---|---|
| 1,027,957 | 5/1912 | Withers et al. | 91/53 |
| 1,232,797 | 7/1917 | Hedendahl | 91/384 |
| 2,802,453 | 8/1957 | Harp et al. | 91/28 |
| 2,804,753 | 9/1957 | Leduc | 91/28 |
| 3,225,544 | 12/1965 | Lemley | 91/28 |
| 3,441,100 | 4/1969 | Stein | 177/208 |
| 3,844,882 | 10/1974 | Bevilacqua | 251/62 X |
| 4,478,129 | 10/1984 | Hannes et al. | 91/1 |
| 4,481,768 | 11/1984 | Goshorn et al. | 60/415 X |
| 4,507,919 | 4/1985 | Smith | 60/404 |
| 4,559,648 | 12/1985 | Affeld et al. | 91/28 X |
| 4,630,441 | 12/1986 | Chamberlain | 60/413 |
| 4,759,256 | 7/1988 | Kovit et al. | 91/32 |

FOREIGN PATENT DOCUMENTS

| | | | |
|---|---|---|---|
| 2339752 | 8/1977 | France | 60/413 |
| 0132906 | 9/1983 | Japan | 91/454 |
| 2042640 | 9/1980 | United Kingdom | 91/1 |

*Primary Examiner*—Edward K. Look
*Assistant Examiner*—Todd Mattingly
*Attorney, Agent, or Firm*—Robert J. Edwards

[57] ABSTRACT

An actuator device for mechanisms located within a pressurized environment including a double acting piston and cylinder combination operating in the same environment. The motive power for the piston is provided by pressurized gas from the pressurized environment or from a substitute source, whereby complex and elaborate sealing systems are eliminated.

2 Claims, 1 Drawing Sheet

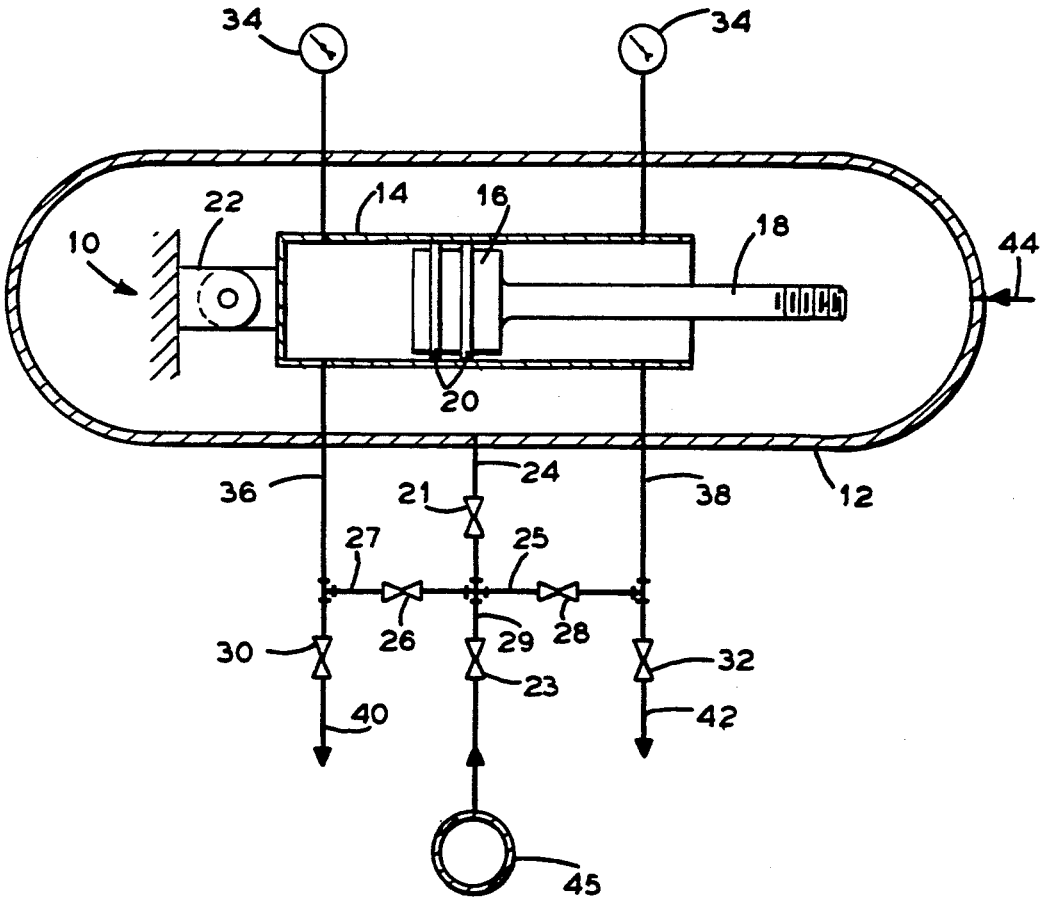
34
34
22
14
16
18
10
44
20
36
24
38
12
21
27
25
26
29
28
30
23
32
40
42
45

ACTIVATOR DEVICE FOR MOVABLE COMPONENTS

BACKGROUND OF THE INVENTION

This invention covers a pneumatically operated double acting piston and cylinder combination operating in a pressurized high temperature environment such as that which exists in a pressurized fluidized bed combustion boiler.

The pressurized fluidized bed combustion boiler is a unique steam generator which incorporates fluidized bed technology with gas turbine technology to effectively burn high sulphur coal while meeting current stringent environmental requirements. The pressurized fluidized bed combustion boiler process removes sulphur during combustion of the coal and because of the low bed and furnace temperatures, approximately 1,600° F., the concentration of nitrogen oxides in the flue gases is extremely low compared to normal pulverized coal fired boiler emissions. Cleaned combustion gases from the process are used to drive a gas turbine which in turn drives an air compressor and an electric generator. For improved efficiency, the pressurized fluidized bed combustion boiler is located within a pressure vessel which operates at pressures between 50 and 250 psia as a function of boiler load. The air compressor associated with the gas turbine provides the means of pressurizing the vessel and also provides combustion air for the process. Because of the severe pressure and temperature conditions prevailing within the pressure vessel, actuators which provide the means for movement of internal mechanisms such as dampers, valves or other controls, are normally located outside the pressure vessel in ambient conditions while complex and elaborate sealing systems are required at pressure boundary penetrations for movable drive mechanisms associated with the actuators.

Double acting piston-cylinder combinations and associated valve arrangements are not new in the art. For example, U.S. Pat. No. 1,027,957 to W. H. Withers et al, discloses a piston-cylinder arrangement in which pressurized fluid is admitted to either side of piston 13 through the action of slide valve 29. U.S. Pat. No. 1,232,797 to T. A. Hedendahl discloses a fluid pressure controlled reversing gear which includes a double acting piston and cylinder combination controlled by a slide valve wherein a common source of fluid pressure provides the motive power. U.S. Pat. No. 3,441,100 to D. E. Stein discloses a pneumatic weight transmitter which operates in a controlled environment, either positive or negative pressure.

SUMMARY OF THE INVENTION

The present invention solves the problem of high pressure, high temperature sealing systems required on pressure boundary penetrations by locating an actuator device within a pressure vessel to provide movement of mechanisms also located within the pressure vessel. A piston-cylinder combination operates the mechanisms, the piston utilizing the pressurization medium from the vessel as a power source, venting to atmosphere, thereby eliminating movable penetrations of the pressure boundary. A substitute source of pressurized medium is provided for use at such times as the vessel is not pressurized.

The various features of novelty which characterize the invention are pointed out with particularity in the claim annexed to and forming a part of this specification. For a better understanding of the invention, its operating advantages and specific objects obtained by its use, reference should be had to the accompanying drawing and descriptive matter in which a preferred embodiment of the invention is illustrated and described.

BRIEF DESCRIPTION OF THE DRAWING

The sole FIGURE of the drawing is a schematic representation of the invention.

DETAILED DESCRIPTION OF THE PREFERRED EMBODIMENT

The drawing schematically illustrates an arrangement of an actuator device 10 located within a pressure boundary or vessel 12 such as, for example, would encompass a pressurized fluidized bed combustion boiler. Pressure within the boundary 12 is maintained by compressed air supply line 44. A cylinder 14 with closed ends is supported within the vessel 12 by conventional means 22. The cylinder 14 houses a double acting piston 16 with rings 20 and piston rod 18 to impart rotary or reciprocating motion to a device (not shown) within the pressurized environment defined by boundary 12. The device connected to the actuator may be, for example, a damper shaft operating in the same environment at up to 250 psi pressure. The motive power for piston 16 is supplied by the differential pressure between that within the enclosed boundary 12 and the atmosphere. This is effected by valves 21, 23, 26, 28, 30 and 32. Valves 28, 30 and 26, 32 work in pairs, either open or closed. To move the piston 16 to the left, valves 21 and 28 are opened and valves 23 and 32 are closed, pressurized air flows from inside vessel 12 through lines 24, 25 and 38 into the right end of cylinder 14. Air is vented through lines 36 and 40 to atmosphere with valve 30 open and valve 26 closed. The reverse process induces motion in the opposite direction. Thus, to move the piston 16 to the right, valves 21 and 26 are opened and valves 23 and 30 are closed, pressurized air flows from inside vessel 12 through lines 24, 27 and 36 into the left end of cylinder 14. Air is vented through lines 38 and 42 to atmosphere with valve 32 open and valve 28 closed. Multiple pressure sensing indicators 34 determine the location of the piston by either indicating vent pressure of the cylinder or the higher chamber pressure.

A substitute source 45 of pressurized air and a supply line 29 are provided for use at such times as the vessel 12 is not pressurized. When the motive power for piston 16 is the pressurized air supplied from substitute source 45, valve 23 is opened and valve 21 is closed. The positioning of valves 28, 30 and 26, 32 will be the same when using the substitute source 45 as when pressurized air is supplied from vessel 12 as described above.

The illustrated embodiment of the invention thus comprises means for admission of pressure gas from the interior of vessel 12 to the opposite sides of piston 16, which includes the vessel pressure supply line 24 having the vessel pressure valve 21 therein, with a first return line 25, 38, and a second return line 27, 36, being connected between the vessel pressure supply line 24 and the cylinder 14 on opposite sides of the piston 16. First and second return valves 28 and 26 respectively are positioned in the return lines. Means for alternately venting the opposite sides of the cylinder to the atmosphere comprise first and second vent lines 42 and 40 respectively with first and second vent valves therein shown at 32 and 30 respectively. The substitute source 45 is connected by the substitute pressure line 29 to the vessel pressure line 24 and has the substitute pressure valve 23 therein.

Valves 21, 23, 26, 28, 30 and 32 are either hand operated or automatically controlled using sensing indicators 34. With the actuator located within the pressure boundary 12 and operating movable components within this same boundary, complex high pressure sealing systems are eliminated for movable penetrations of the pressure boundary. All penetrations involved in the invention are simple line penetrations such as for valving and pressure sensing presenting no sealing problems.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features.

The embodiments of the invention in which an exclusive property or privilege is claimed are defined as follows:

1. A pressure vessel (12), means (44) for pressurizing the vessel with a gas, an actuator device (10) located within the pressurized environment of the vessel to operate mechanisms within the same environment and comprising a cylinder (14) with closed ends supported within the pressure vessel, a double acting piston (16) within the cylinder, a plurality of pressure sensing indicators (34), with one indicator being directly connected to each end of the cylinder, means for admission of pressurized gas from the vessel alternately to each side of the piston, and means for alternately venting the cylinder at each side of said piston to the atmosphere, whereby complex and elaborate sealing systems are eliminated, the means for admission of pressurized gas comprising a vessel pressure supply line (24) connected to the pressure vessel (12) and communicating with the pressurized environment in the pressure vessel, a vessel pressure valve (21) in the vessel pressure supply line (24), a first return line (25, 38) connected between the vessel pressure supply line (24) and the cylinder (14) on one side of the piston (16), a first return valve (28) in the first return line, a second return line (27, 36) connected between the vessel pressure supply line (24) and the cylinder (14) on an opposite side of the piston (16), a second return valve (26) in the second return line, the means for alternately venting the cylinder comprising a first vent line (42) connected to the first return line (25, 38) at a location between the first return valve (28) and the cylinder (14), the first vent line communicating with the atmosphere, a first vent valve (32) in the first vent line (42), a second vent line (40) connected to the second return line (27, 36) between the second return valve (26) and the cylinder (14), the second vent line communicating with the atmosphere, and a second vent valve (30) in the second vent line.

2. A pressure vessel in accordance with claim 1 including a substitute source (45) of pressurized gas, a substitute pressure line (29) connected between the substitute source and the vessel pressure supply line 24, and a substitute pressure valve 23 in the substitute pressure line.

* * * * *